US009103211B2

(12) United States Patent
White, Jr.

(10) Patent No.: US 9,103,211 B2
(45) **Date of Patent: *Aug. 11, 2015**

(54) STATOR OF A GEROTOR DEVICE AND A METHOD FOR MANUFACTURING ROLLER POCKETS IN A STATOR OF A GEROTOR DEVICE

(71) Applicant: WHITE DRIVE PRODUCTS, INC., Hopkinsville, KY (US)

(72) Inventor: Hollis N. White, Jr., Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 324 days.

This patent is subject to a terminal disclaimer.

(21) Appl. No.: 13/738,067

(22) Filed: Jan. 10, 2013

(65) Prior Publication Data

US 2013/0183182 A1 Jul. 18, 2013

Related U.S. Application Data

(63) Continuation-in-part of application No. PCT/US2012/040835, filed on Jun. 5, 2012, which is a continuation-in-part of application No. 13/193,946, filed on Jul. 29, 2011, now Pat. No. 8,678,795.

(51) Int. Cl.
*F01C 1/02* (2006.01)
*F01C 1/063* (2006.01)
(Continued)

(52) U.S. Cl.
CPC ..... *F01C 21/106* (2013.01); *B24B 19/06* (2013.01); *B24B 19/09* (2013.01); *F04C 2/086* (2013.01); *F04C 2/103* (2013.01); *F04C 2230/10* (2013.01)

(58) Field of Classification Search
CPC ..... B24B 19/06; B24B 19/09; F01C 21/106; F04C 2/086
USPC ..... 418/61.3, 178–179, 171, 225, 150
See application file for complete search history.

(56) References Cited

U.S. PATENT DOCUMENTS 3,438,156 A 4/1969 Lasko
3,563,679 A 2/1971 Richardson
(Continued)

FOREIGN PATENT DOCUMENTS

DE 2421304 11/1974
GB 1219081 1/1971
WO 2012/058527 5/2012

OTHER PUBLICATIONS

International Search Report filed in PCT/US2012/040835.
(Continued)

*Primary Examiner* — Thai Ba Trieu
*Assistant Examiner* — Deming Wan
(74) *Attorney, Agent, or Firm* — Rankin, Hill & Clark LLP

(57) ABSTRACT

A method for manufacturing roller pockets in a stator of a gerotor device generally includes providing a stator having a cavity including a generally cylindrical section defining a central axis and a plurality of roller pockets angularly spaced around a periphery of the cylindrical section. Each roller pocket is configured to receive a respective roller, which acts as an internal tooth of the gerotor device. Each roller pocket defines a generally cylindrical roller pocket bearing surface. The method further includes grinding each roller pocket bearing surface of each roller pocket with a grinding wheel rotating about a rotational axis perpendicular to the central axis. A stator for a gerotor device is also described.

18 Claims, 8 Drawing Sheets

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/10*** | (2006.01) |
| ***B24B 19/09*** | (2006.01) |
| ***B24B 19/06*** | (2006.01) |
| ***F04C 2/10*** | (2006.01) |
| ***F04C 2/08*** | (2006.01) |

(56) References Cited

U.S. PATENT DOCUMENTS

| | | | | |
|---|---|---|---|---|
| 3,591,320 | A | 7/1971 | Woodling | |
| 3,668,947 | A * | 6/1972 | Waldorff | 475/168 |
| 3,930,766 | A | 1/1976 | Swedberg | |
| 4,008,015 | A | 2/1977 | McDermott | |
| 4,058,938 | A | 11/1977 | Harle et al. | |
| 4,087,215 | A | 5/1978 | Miller | |
| 4,170,851 | A | 10/1979 | Enos | |
| 4,592,173 | A | 6/1986 | White | |
| 4,859,160 | A | 8/1989 | White | |
| 5,030,072 | A | 7/1991 | Wenker | |
| 5,336,069 | A * | 8/1994 | Matsuyama | 418/206.5 |
| 5,595,479 | A | 1/1997 | Hansen et al. | |
| 7,431,635 | B2 | 10/2008 | Dong et al. | |
| 7,481,633 | B2 | 1/2009 | White | |
| 7,726,958 | B2 | 6/2010 | Pedersen et al. | |
| 8,221,102 | B2 | 7/2012 | Pedersen et al. | |
| 8,678,795 | B2 * | 3/2014 | White, Jr. | 418/1 |
| 2004/0022660 | A1 * | 2/2004 | Eisenmann et al. | 418/171 |
| 2007/0134119 | A1 | 6/2007 | Pedersen et al. | |
| 2010/0080721 | A1 * | 4/2010 | Yuan et al. | 418/1 |

OTHER PUBLICATIONS

Extended European Search Report filed in EP 12819585 mailed Feb. 6, 2015.

* cited by examiner

STATOR OF A GEROTOR DEVICE AND A METHOD FOR MANUFACTURING ROLLER POCKETS IN A STATOR OF A GEROTOR DEVICE

This application is a continuation-in-part of PCT/US12/40835, filed Jun. 5, 2012, which is incorporated by reference herein.

BACKGROUND

A hydraulic gerotor device includes a stator having internal teeth and a rotor having external teeth. The rotor is mounted eccentrically within the stator. There is one more internal tooth on the stator than external teeth on the stator. The internal teeth of the stator can be formed by cylindrical rollers, which reduce wear in the gerotor device between the rotor and the stator.

The cylindrical rollers fit into roller pockets found in the stator. It is known to form these pockets by broaching. A great degree of precision is needed in the final inside diameter of the roller pockets, and it is also desirable to harden the inside diameter of each roller pocket since the inside diameter acts as a bearing surface for the cylindrical rollers. Typically, the internal bearing surface of each roller pocket covers an arc of 180° around the respective roller received therein.

It is also known to hone the roller pockets in a stator. A plurality of similar individual tapered abrasive hones are passed through roller pockets cut into a stator. The hones have outer frusto-conical surfaces and rotate about an axis parallel with a central axis of the stator. The honing process produces adequate results; however, honing requires a highly skilled machine operator.

SUMMARY

A stator for a gerotor device includes a plurality of rollers and a stator body having a forward face, a rear face, a cavity including a generally cylindrical section defining a central axis and a plurality of roller pockets angularly spaced around a periphery of the cylindrical section. Each roller pocket receives a respective roller, which acts as an internal tooth of the stator. Each roller pocket includes a generally cylindrical roller pocket bearing surface, against which the respective roller received in the roller pocket bears. The roller pocket bearing surface extends along an arc that partially surrounds the respective roller received in the respective roller pocket, and the arc is greater than 185 degrees. Each bearing surface includes a first section following a first curve and a second section following a second curve. Each curve is substantially circular. The first curve is a substantial mirror image of the second curve with respect to a center line through the respective roller pocket. The respective bearing surface deviates from each curve at or adjacent an area of the respective bearing surface intersected by the center line. The first curve follows a first radius and the second curve follows a second radius, which is equal in magnitude to the first radius. The first radius emanates from a first point located on the same side of the center line of the roller pocket and closer to the first section of the bearing surface as compared to a rotational axis of the roller when the gerotor device is in an unpressurized state.

A method for manufacturing roller pockets in a stator of a gerotor device generally includes providing a stator having a cavity including a generally cylindrical section defining a central axis and a plurality of roller pockets angularly spaced around a periphery of the cylindrical section. Each roller pocket is configured to receive a respective roller, which acts as an internal tooth of the gerotor device. Each roller pocket defines a generally cylindrical roller pocket bearing surface. The method further includes grinding a first section of the roller pocket bearing surface of each roller pocket with a grinding wheel rotating about a rotational axis perpendicular to the central axis while a second section of the roller pocket bearing surface is not in contact with the grinding wheel. The first section is located on a first side of a center line of the roller pocket and the second section is located on a second, opposite, side of the center line. The method further includes grinding the second section of the roller pocket bearing surface of each roller pocket with the grinding wheel rotating about a rotational axis perpendicular to the central axis while the first section of the roller pocket bearing surface is not in contact with the grinding wheel.

DETAILED DESCRIPTION

Figure 1:
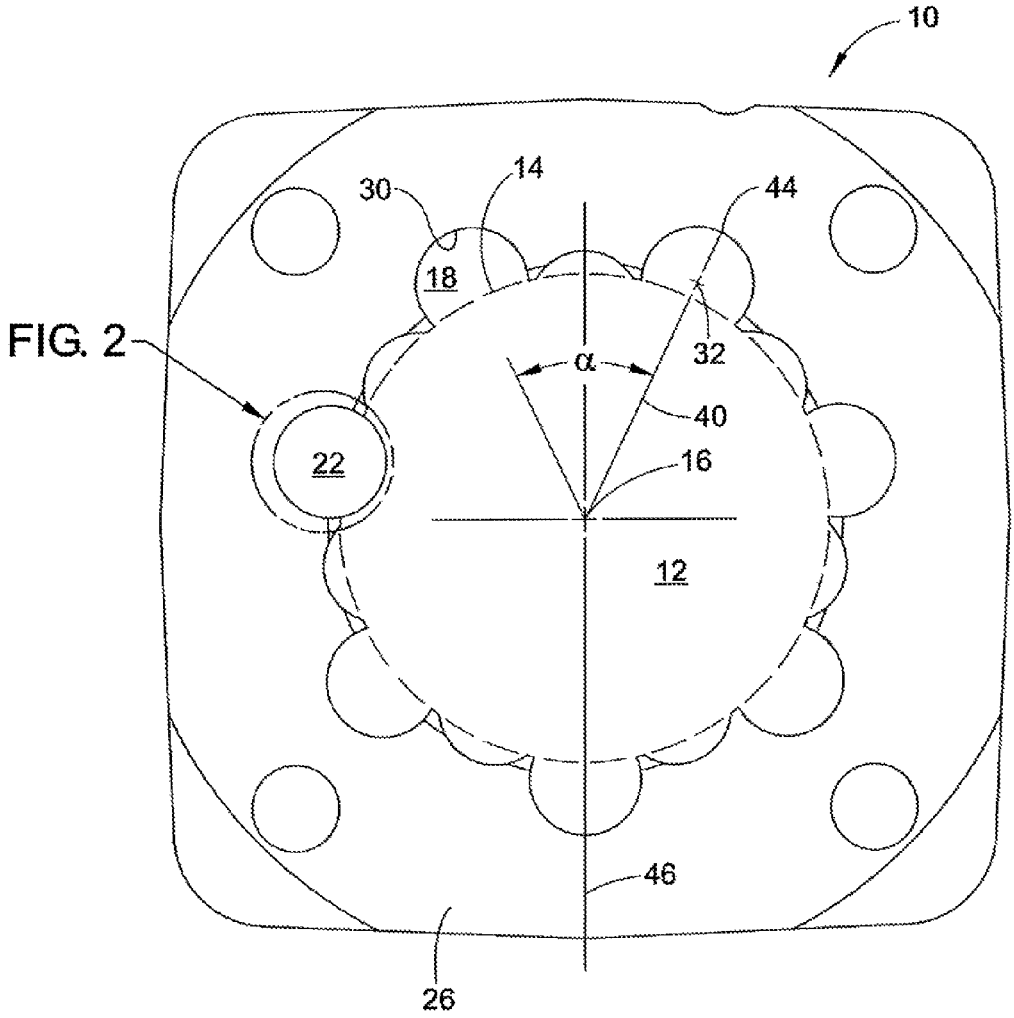
FIG. 1 is a diagrammatic view of a stator for a gerotor device. Only one roller is shown received a respective roller pocket of the stator depicted in FIG. 1.

FIG. 1 shows a stator 10 of a hydraulic gerotor device. The stator 10 includes a stator body provided with a cavity 12 including a generally cylindrical section (depicted by dashed circle 14 in FIG. 1) defining a central axis 16 of the stator and a plurality of roller pockets 18 around a periphery of the cylindrical section. Each roller pocket 18 is configured to receive a respective roller 22 (only one roller is shown in FIG. 1). Each roller 22 acts as an internal tooth of the gerotor device. The roller pockets 18 are angularly spaced from one another around the periphery of the cavity 12. As depicted, each roller pocket 18 is angularly spaced from adjacent roller pockets by an angle $\alpha$.

Figure 7:
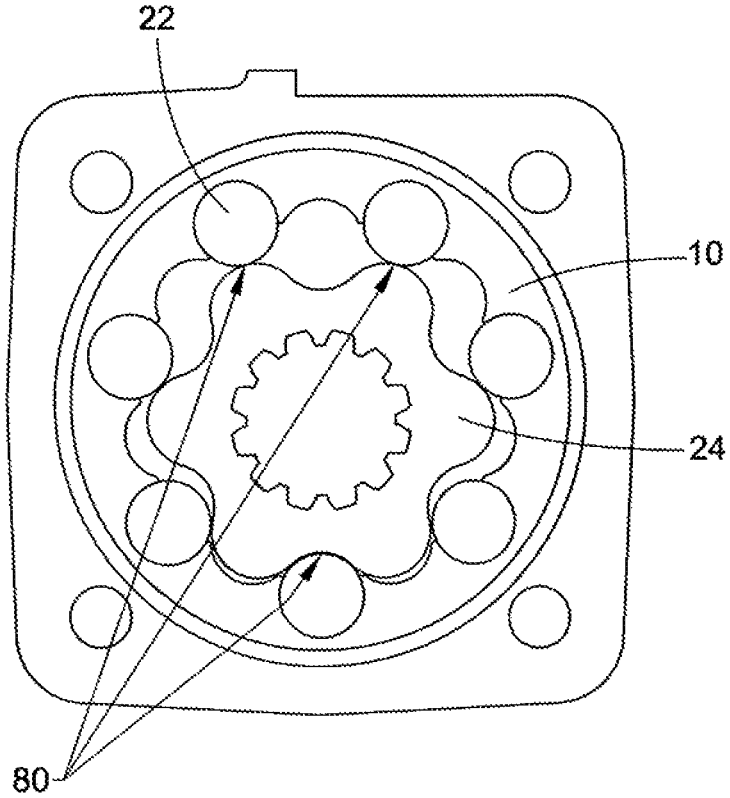
FIG. 7 depicts a rotor and stator for a gerotor device with the rotor in a first position with respect to the stator.
Figure 8:
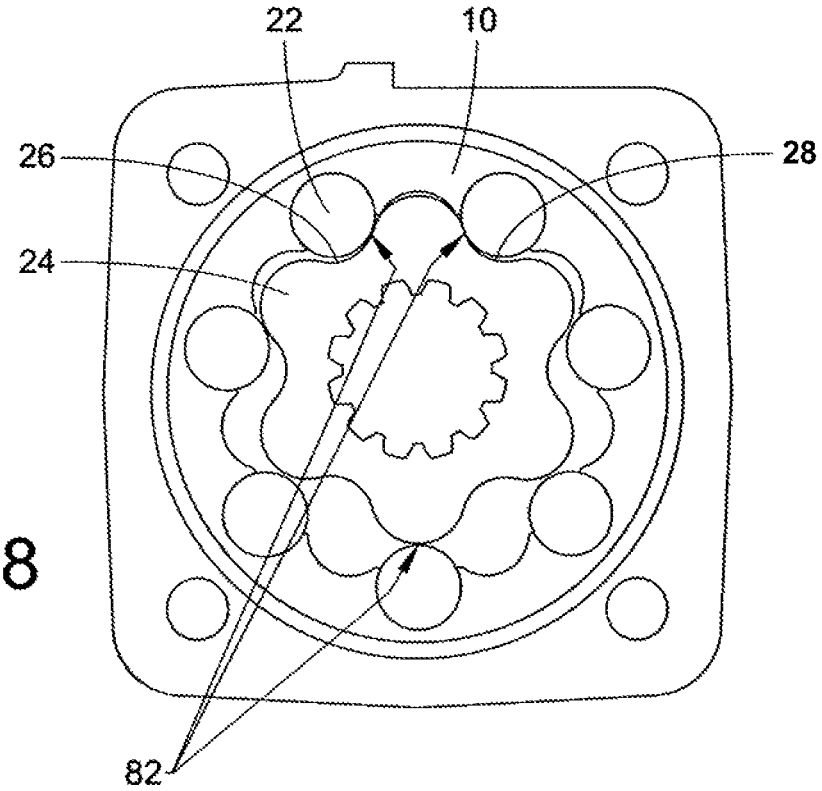
FIG. 8 depicts the rotor and stator of FIG. 7, with the rotor in a second position.

The stator 10 acts as an internally-toothed member that eccentrically receives an externally-toothed rotor 24 (see FIGS. 7 and 8). The rotor 24 is known in the gerotor arts. The rotor has one less external tooth than the internal teeth of the stator 10 to define a number of fluid pockets, which expand and contract upon the rotor's orbital and rotational movement within the stator. The stator 10 includes a forward face 26 and a rear face (not visible in FIG. 1) opposite the forward face. Each of the forward face 26 and the rear face are generally planar and normal to the central axis 16 of the stator 10 to promote a fluid tight seal with other components of a machine that includes the gerotor device.

Each roller pocket 18 includes a generally cylindrical roller pocket bearing surface 30. The respective roller 22 received in the roller pocket 18 bears against the roller pocket bearing surface 30. Each roller pocket bearing surface 30 extends along an arc depicted in FIG. 2 by angle θ from a first end 30*a* to a second end 30*b*. The arc, and thus the bearing surface 30, partially surrounds the respective roller 22 received in the roller pocket 18. The arc, as represented by the angle θ in FIG. 2, can be greater than about 175° with respect to a nominal center point 32 of the respective roller pocket 18. More particularly, each bearing surface 30 can extend along an arc greater than 185° or 190° with respect to the nominal center point 32 of the respective roller pocket 18. Even more particularly, each bearing surface 30 can extend along an arc between about 185° and about 220° with respect to the nominal center point 32 of the respective roller pocket 18. Extending the arc of the bearing surface 30 beyond 180° provides a circumferentially longer bearing surface for the roller 22 as compared to known stators. A larger bearing surface provides an advantage in that a smaller diameter roller is able to withstand greater pressures because the pressure exerted on the roller 22 by the rotor is distributed across a greater surface area, as compared to a roller that is received in a typical roller pocket, which extends along an arc of 180°.

Figure 2:
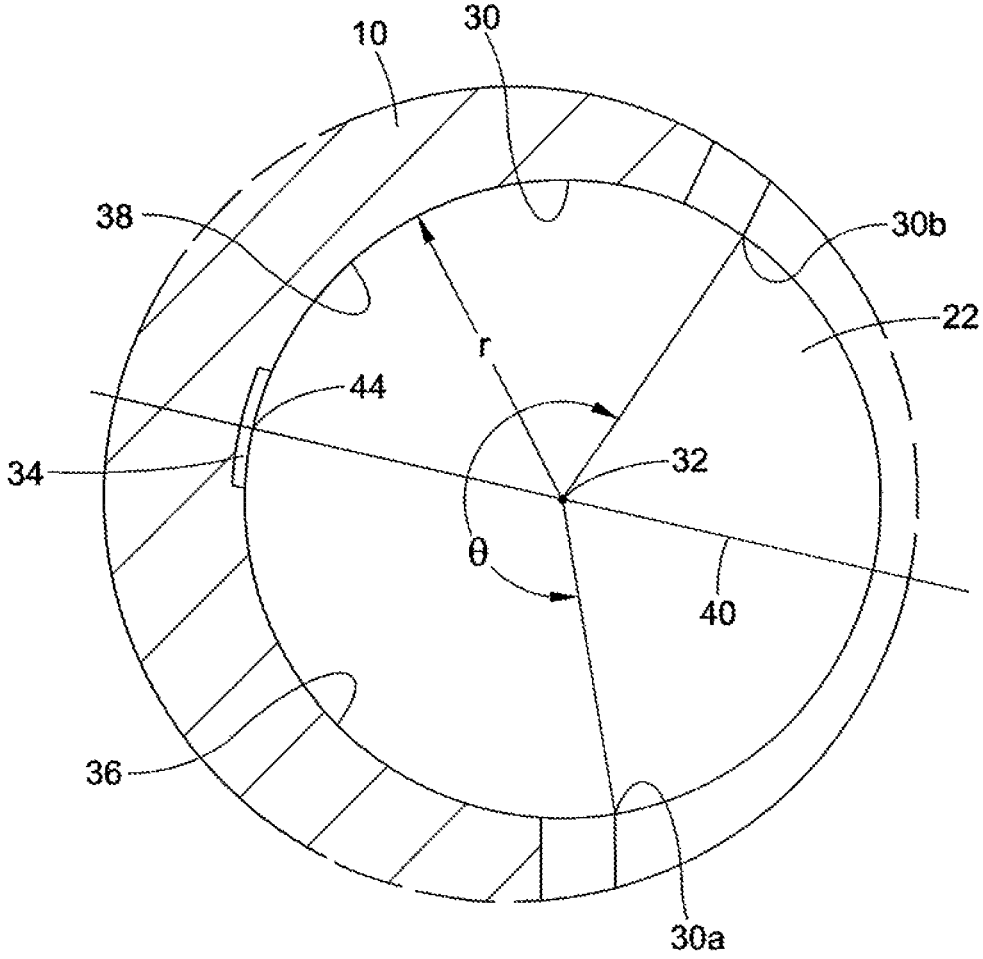
FIG. 2 is an enlarged view of a portion of FIG. 1.

Each roller pocket bearing surface 30 follows a generally constant radius r but for a notch 34 (FIG. 2) formed in each roller pocket 18. Each roller pocket bearing surface 30 includes a first section 36 that is disposed on a first side of the notch 34 and a second section 38 disposed on a second side, which is opposite the first side, of the notch. As illustrated in FIG. 2, the first section 36 and the second section 38 follow the radius r, which is also substantially the same as the radius of each roller 22 received in the pocket 18. The notch 36 is where the bearing surface 30 deviates from the radius of the remainder of the bearing surface outside of the notch. The notch 34 can be very small, e.g. a 0.0002 inches gap is provided between the bearing surface 30 at the notch 34 and the roller 22. In the illustrated embodiment, the notch 34 is centered with respect to the roller pocket 18.

Each roller pocket 18 defines a center line 40 which intersects the nominal center point 32 (the nominal center point is coincident with the axis of rotation of the roller 22) of each roller pocket 18 and the central axis 16 of the stator 10. The radius r emanates from the nominal center point 32 to the first section 36 and the second section 38 of the bearing surface 30. The first section 36 of the bearing surface 30 is located on a first side of the center line 40 of the respective roller pocket and the second section 38 is located on a second, opposite, side of the center line. For the embodiment shown in FIG. 2, where the center line 40 of the pocket 18 intersects the bearing surface 30 at a 12:00 o'clock position, the first section 36 extends along an arc to at least (and preferably beyond) a 9:00 o'clock position and the second section 38 extends along an arc to at least (and preferably beyond) a 3:00 o'clock position.

The cavity 12 in the stator 10 is symmetrical with respect to a plurality of symmetrical axes 46. Only one symmetrical axis 46 is shown in FIG. 1. Each symmetrical axis 46 intersects the nominal center point 32 of each roller pocket 22 and the central axis 16 (FIG. 1). The notch 34 can be centered with respect to the center line 40, i.e. the notch 34 can terminate and thus transition into the first section 36 and the second section 38, respectively, equidistant from where the center line 40 intersects the bearing surface 30. The intersection of the center line 40 and the bearing surface 30 is depicted at 44 in FIG. 1.

Figure 3:
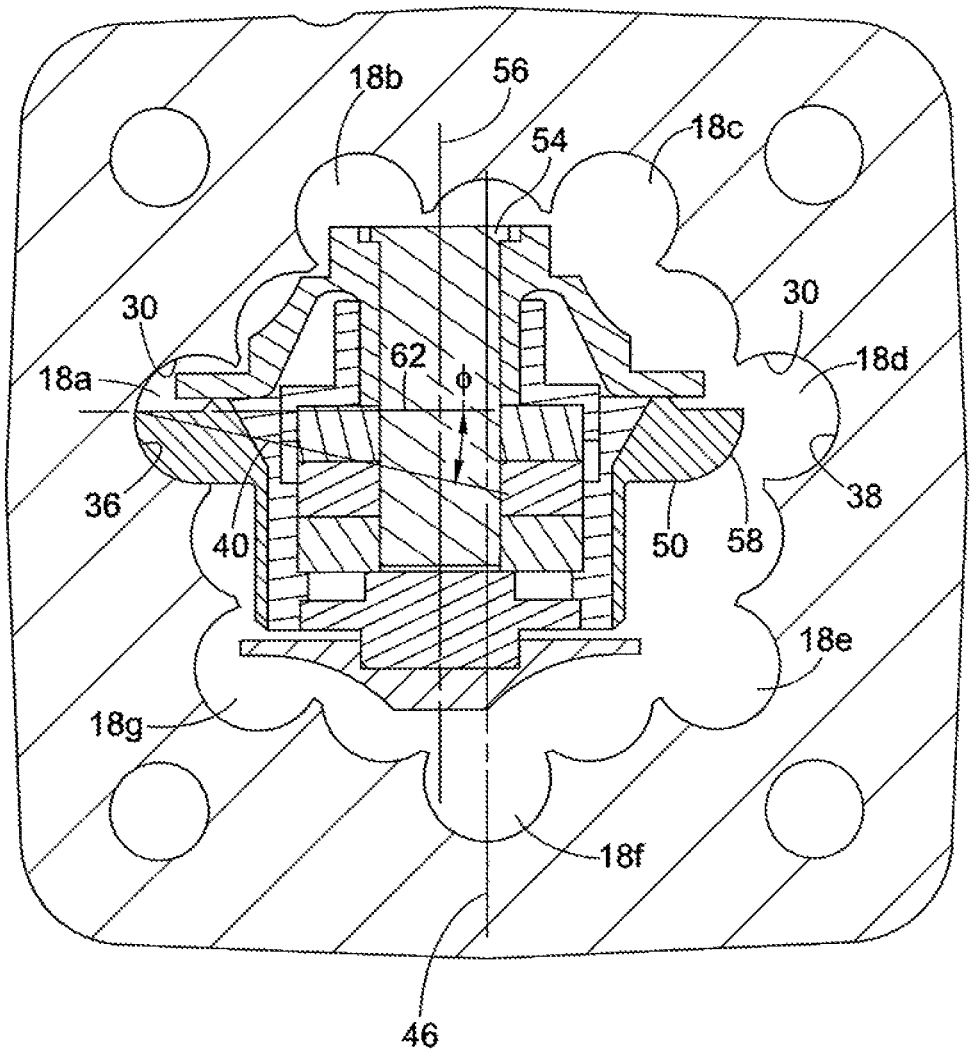
FIG. 3 is a sectional view of the stator shown in FIG. 1 and a grinding wheel assembly grinding a roller pocket in the stator.

With reference to FIG. 3, each roller pocket bearing surface 30 is ground with a grinding wheel 50 of a grinding wheel assembly 52. The grinding wheel assembly 52 includes a spindle 54 to which the grinding wheel 50 is connected. The spindle 54 defines a rotational axis 56 about which both the spindle and the grinding wheel 50 rotate. The grinding wheel 50 includes a contact surface 58, which in cross section taken normal to the central axis 16 of the stator 10, follows the radius r of the roller pocket bearing surface 30. The grinding wheel 50 rotates, generally, in a plane normal to the central axis 16 of the stator 10. When grinding a respective roller bearing surface 30, the grinding wheel assembly 52 moves with respect to the stator 10 in an axial direction, which is parallel to the central axis 16 of the stator.

As shown in FIG. 3, the contact surface 58 of the grinding wheel 50 follows an arc that is substantially less than 180°. Because of this configuration, each bearing surface 30 of each roller pocket 18 is ground at least twice. FIG. 3 depicts the stator 10 including roller pockets 18*a*-18*g*. A fewer or greater number of roller pockets can be provided. Where the center point 44 (FIG. 2) on the bearing surface 30 is at the 12:00 o'clock position, the grinding wheel 50 can grind the first section 36 of each bearing surface 30 between about the 12:00 o'clock to about the 8:00 o'clock position. By indexing the stator 10 with respect the grinding wheel 50, or vice versa, the second section 38 of each bearing surface 30 can be ground between about the 12:00 o'clock position to about the 4:00 o'clock position. Accordingly, grinding the bearing surface 30 of a respective roller pocket, e.g. pocket 18*a*, includes grinding the first section 36 of the bearing surface 30 of the respective roller pocket 18*a* while the second section 38 and the notch 34 of the respective bearing surface are not in contact with the grinding wheel 50. Grinding the bearing surface 30 of the roller pocket 18*a* further includes grinding the second section 38 of the bearing surface of the roller pocket while the first section 36 and the notch 34 of the respective bearing surface is not in contact with the grinding wheel 50. This prolongs the life of the grinding wheel 50, which is discussed below. The stator 10 is indexed with respect to the grinding wheel 50, or vice versa, after the first section 36 is ground and before the second section 38 is ground, or vice versa.

FIG. 3 depicts the grinding of the first section 36 of the bearing surface 30 of the roller pocket 18*a*. To grind the second section 38 of the bearing surface 30 of the roller pocket 18*a*, the stator 10 is indexed with respect to the grinding wheel 50, or vice versa. After grinding the first section 36 of the bearing surface 30 of the roller pocket 18*a*, the grinding wheel 50 can be moved, or translated, with respect to the stator 10, or vice versa, in a direction perpendicular to the symmetrical axis 46, which is parallel to the rotational axis 56 of the grinding wheel 50. Per the orientation shown in FIG. 3, after grinding the first section 36 of the bearing surface 30 of the roller pocket 18*a*, the grinding wheel 50 is moved with respect to the stator 10, or vice versa, such that the grinding wheel 50 contacts the second section 38 of the bearing surface 30 of roller pocket 18*d*. As such, a single indexing of the stator 10 with respect to the grinding wheel 50, or vice versa, allows two different pockets, i.e. pockets 18*a* and 18*d*, to both be ground. If desired, the diameter of the grinding wheel 50 can be increased or the dimensions of the cavity 12 can be decreased, such that the grinding of the first section 36 of the bearing surface 30 for the roller pocket 18*a* and the grinding of the second section 36 of the bearing surface 30 of the roller pocket 18*d* can be performed simultaneously.

After grinding the second section 36 of the bearing surface 30 of the roller pocket 18*d*, the stator 10 is indexed with respect to the grinding wheel 50, or vice versa, the angle α about the central axis 16 of the stator. Indexing the grinding wheel 50 with respect to the stator 10 in the clockwise direction (per the orientation shown in FIG. 3) allows for the grinding of the first section 34 of the bearing surface 30 for the roller pocket 18*b* and the grinding of the second section 36 of the bearing surface 30 for the roller pocket 18*e*. The steps of grinding the first section of the bearing surface of a roller pocket located on a first side of the respective symmetrical axis of the stator and grinding a second section of the bearing surface of another roller pocket, which is located on an opposite side of the respective symmetrical axis, can be repeated until each roller pocket has been ground in both the first and the second sections. This allows for a single indexing for the grinding of two roller pockets.

The notch 34, which is depicted in FIG. 2, is not visible in FIG. 3. However, each of the roller pockets 18*a*-18*g* can include such a notch 34 where the bearing surface deviates from the radius r of the remainder of the bearing surface. The notch 34 can be centered with respect to the center point 44 on the bearing surface 30 of each roller pocket.

By providing the notch 34, a relief is provided for the grinding wheel 50. A truer indexing of the stator 10 with respect to the grinding wheel 50 is manageable because of the notches 34 provided in each respective roller pocket 18. In the illustrated embodiment, the grinding wheel 50 is a CBN grinding wheel. Re-grinding of a surface that is already been ground with a CBN grinder can lead to dulling of the grinding wheel. The notches 34 and the bearing surfaces 30 of each roller pocket 18*a*-18*g* offsets the contact surface 58 of the grinding wheel 50 from the bearing surface 30 so that the area of each bearing surface 30 around the 12:00 o'clock position is not ground. This increases the life of the grinding wheel. The notch 34 also allows hydraulic fluid to enter into the space between the roller pocket bearing surface 30 and the roller 22 to provide lubrication for the rollers and to provide hydrostatic pressure to counteract forces being applied on the roller bearing surface as the rotor acts against the rollers.

With reference to FIG. 3, a plane 62 that is normal to the rotational axis 56 of the grinding wheel 50 is angularly offset at an angle $\phi$ with respect to the center line 40, which intersects the nominal center point 32 of the respective roller pocket 18 that is being ground and the central axis 16 of the stator 10. The angle $\phi$ is greater than zero. Contact of the contact surface 58 of the grinding wheel 50 with the bearing surface 30 is more in line with the pressure angle exerted by the rotor on the roller 22 as compared to the bearing surfaces that are honed using the prior art method.

FIG. 2 depicts the first section 36 and the second section 38 each following a constant radius r. Alternatively, the first section 36 can follow a first curve and the second section can follow a second curve. Each curve can be substantially circular, i.e., follow an arc of a circle; however, each section 36 and 38 need not follow a constant radius. This is possible by use of the grinding wheel 50 and an appropriately shaped contact surface 58. Since the same contact surface 58 would be used to grind each section 36 and 38, the first curve would be a substantial mirror image of the second curve with respect to a mirror line through the respective roller pocket 22. In the example illustrated in FIG. 2, the mirror line would be coincident with the center line 40. The bearing surface 30 would deviate from each curve, i.e., the first curve and the second curve, at or adjacent an area of the respective bearing surface intersected by the mirror line.

Figure 4:
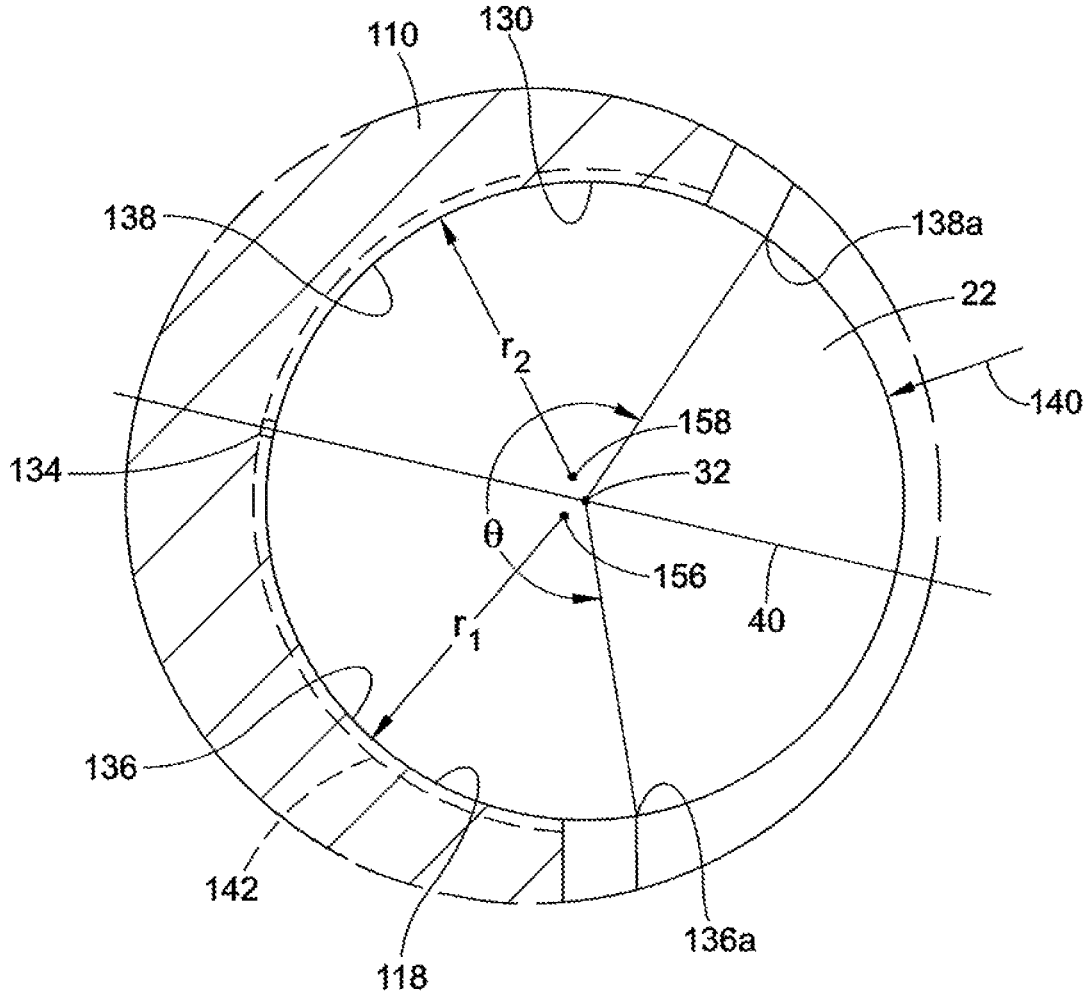
FIG. 4 is an enlarged view of a portion of a stator having a roller pocket different in configuration than the stator depicted in FIG. 1.

FIG. 4 depicts a portion of a stator 110 similar to the stator 10 depicted in FIG. 2 with the exception that a roller pocket 118 that is different than the roller pocket 18 depicted in FIG. 2. The stator 110 would include a plurality of these roller pockets 118 that are described with reference to FIG. 4 to provide a stator that is similar to the stator 10 depicted in FIG. 2.

Each roller pocket 118 includes a bearing surface 130 having a first section 136 that is disposed on a first side of a notch 134 (or flat section) and a second section 138 disposed on a second side, which is opposite the first side, of the notch (or flat section). The first section 136 and the second section 138 can follow a radius of equal magnitude. A first radius $r_1$ emanates from a first point 156 to the first section 136. The first section 136 follows the first radius $r_1$ from an end 136*a* of the first section 136 to the notch 134. A second radius $r_2$ emanates from a second point 158 to the second section 138 of the bearing surface 130. The second section 138 follows the second radius $r_2$ from an end 138*a* of the second section 138 to the notch 134. Each end 136*a* and 138*a* is where the bearing surface 130 transitions into the generally cylindrical section 14 of the stator 12.

In the illustrated embodiment, the first point 156 is offset from the second point 158 and the nominal center point 32 of the respective roller pocket 118. The nominal center point 32 is coincident with the axis of rotation of the roller 22 when the gerotor device is unpressurized. The first point 156 is located on the same side of the center line 40 of the roller pocket 118 and closer to the first section 136 of the bearing surface 130 as compared to a rotational axis of the roller 22 when in an unpressurized state. The second point 158 can be coincident with the nominal center point 32, although the second point 258 may be offset from the nominal center point 32. For example, the second point 258 can be located on the same side of the center line 40 of the roller pocket 118 and closer to the second section 138 of the bearing surface 130 as compared to a rotational axis of the roller 22 when in an unpressurized state, as shown in FIG. 4.

In the embodiment illustrated in FIG. 4, the first point 156 is offset from the second point 158 a very small distance, e.g., about 2 microns. The first radius $r_1$ can provide an interference layout of −0.002 inches with respect to the diameter of the roller 22 (e.g., the first radius $r_1$ is less than the radius of the roller 22). The second radius $r_2$ can provide an interference layout with respect to the diameter of the roller 22 (e.g., the second radius $r_2$ is less than the radius of the roller 22), or the second radius $r_2$ can allow for free turning of the roller 22 when the gerotor device is not pressurized.

Similar to the roller pocket 18 described in FIG. 2, the bearing surface 130 includes the notch 134 or a flat section interposed between the first section 136 and the second section 138. The notch 134 is where the bearing surface 130 deviates from the radii of the remainder of the bearing surface outside of the notch. The notch 134 can be very small, e.g. a 0.0002 inches gap is provided between the bearing surface 130 at the notch 134 and the roller 22. As shown in FIG. 4, the notch 134 is centered with respect to the roller pocket 118.

By offsetting the first point 156 from the second point 158, while keeping the magnitude of the radii $r_1$ and $r_2$ the same and substantially equal to the radius of the roller 22, the roller pocket 118 is designed so that the radii $r_1$ and $r_2$ fit the roller 22 with the gerotor device in an unpressurized state. This results in the rotor set, which includes the rotor 24 (FIGS. 6 and 7) and the stator 110, being loose when not pressurized. This allows for easier rotation of the output shaft (not shown), and should also result in less drag.

By offsetting the first point 156 and the second point 158 from the nominal center point 32, while keeping the magnitude of the radii $r_1$ and $r_2$ the same and slightly smaller than the radius of the roller 22 (i.e., providing an interference fit) forces offset from the center line 40 of the roller pocket 118 can be better counteracted. For example, when a force in the direction of arrow 140 is applied to the roller 22 from the rotor 24 (see FIGS. 6 and 7), the roller 22 is pushed toward the first section 136 and away from the second section 138 of the bearing surface 130. When the gerotor device is pressurized, the stator 110 also slightly expands due to this pressurization. Where there is a slight interference fit (e.g., $r_1$ and $r_2$ are 0.2499" and the diameter of the roller 22 is 0.500691"), hydraulic fluid can flow from the fluid pocket (defined by the rotor 24 and the roller 22) between the roller 22 and the second section 138 of the bearing surface 130 when the gerotor device is pressurized. This reduces the friction between the roller 22 and the bearing surface 130, which allows the roller 22 to roll more easily with respect the stator 110 as pressure is being applied to the roller 22 by the rotor 24. Contact between the roller 22 and the first section 136 of the bearing surface 130 provides a seal to minimize the migration of fluid from between the roller 22 and the bearing surface 130 between adjacent fluid pockets. Since the bearing surface 130 extends along an arc that is greater than 180 degrees, the radii $r_1$ and $r_2$ can extend from the notch 134 to the respective ends 136*a* and 138*a* without deviating or increasing nearer the ends 136*a*, 136*b* while still accommodating for rotational movement of the roller 22 with respect to the stator 24.

As seen in FIG. 4, when a force, e.g., the force depicted by arrow 140, is applied on one side of the centerline 40, the roller 22 shifts toward the section of the bearing surface 130 on the opposite side of the center line 40. Hydraulic fluid can then flow between the section of the bearing surface 130 that is located on the same side of the center line 40 and the roller 22. To allow for more fluid to reside between the roller 22 and the bearing surface 130, circumferential grooves 142 can be formed in the bearing surface 130. These circumferential grooves 142 can be formed by moving the grinding wheel 50 in a direction perpendicular to the central axis 16 (FIG. 1) and into the bearing surface 130 as the grinding wheel 50 is grinding the bearing surface 130. Even though the circumferential grooves are shown extending from the end 136*a* to the end 138*a* in FIG. 4, each circumferential groove may only extend from a respective end 136*a* or 138*a* to the notch 134. This is because each circumferential groove 142 is formed during the grinding process, and the first section 136 of the bearing surface 130 is ground at a different time than the second section 138 of the bearing surface. As such, a circumferential groove 142 formed in the first section 136 of the bearing surface 130 can be offset in an axial direction (parallel with the central axis 16 in FIG. 1) from a circumferential groove 142 formed in the second section 138 of the bearing surface 130.

The circumferential grooves 142 may not extend all the way to the respective ends 136*a*, 138*a*. If the circumferential grooves 142 do not extend all the way to the respective ends 136*a*, 138*a*, then the roller 22 and the bearing surface 130 near each respective end 136*a* or 138*a* can better seal when a force is being applied on the roller 22. For example, if the circumferential groove 142 were to end prior to the end 136*a* of the first section 136 of the bearing surface, then when the force in the direction of arrow 140 is applied on the roller 22 by the stator 24 the roller 22 and the bearing surface 130 can better seal adjacent the end 136*a*.

Figure 5:
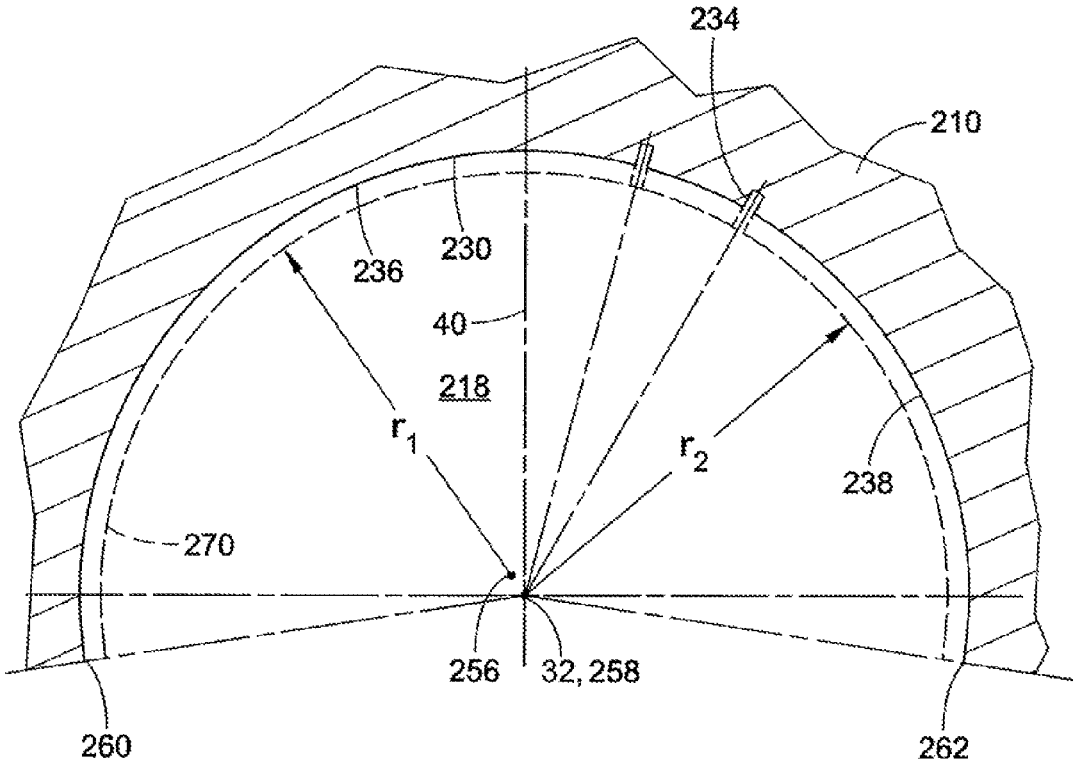
FIG. 5 is an enlarged view of a portion of a stator having a roller pocket different in configuration than the stator depicted in FIGS. 1 and 4.

FIG. 5 depicts a portion of a stator 210 similar to the stator 10 depicted in FIG. 2 with the exception that a roller pocket 218 that is different than the roller pocket 18 depicted in FIG. 2. The stator 210 would include a plurality of these roller pockets 218 that are described with reference to FIG. 5 to provide a stator that is similar to the stator 10 depicted in FIG. 2.

Each roller pocket 218 includes a bearing surface 230 having a first section 236 that is disposed on a first side of the center line 40 of the roller pocket 218 and a second section 238 disposed on a second side, which is opposite the first side, of the center line. The first section 236 and the second section 238 can follow a radius of equal magnitude. A first radius $r_1$ emanates from a first point 256 to the first section 236. A second radius $r_2$ emanates from a second point 258 to the second section 238 of the bearing surface 230. Since the same grinding wheel 50, described above, is used to grind the first section 236 and the second section 238, the first radius $r_1$ is equal in magnitude to the second radius $r_2$. In the illustrated embodiment, the first point 256 is offset from the second point 258 and the nominal center point 32 of the respective roller pocket 218. The nominal center point 32 is coincident with the axis of rotation of the roller 22 (not shown in FIG. 5, see FIG. 2). The first point 256 is located on the same side of the center line 40 of the roller pocket 218 and closer to the first section 236 of the bearing surface 230 as compared to a rotational axis of the roller 22 when in an unpressurized state. As illustrated, the second point 258 is coincident with the nominal center point 32, although the second point 258 may be offset from the nominal center point 32.

In the embodiment illustrated in FIG. 5, the first point 256 is offset from the second point 258 a very small distance, e.g., about 2 microns. The first radius $r_1$ can provide an interference layout of −0.002 inches with respect to the diameter of the roller 22. The second radius $r_2$ can provide an interference layout with respect to the diameter of the roller 22, or the second radius $r_2$ can allow for free turning of the roller 22 when the gerotor device is not pressurized.

Different than the roller pocket 18 described in FIG. 2, the bearing surface 230 includes a plurality of notches, or grooves, 234 formed along the bearing surface 230. Each notch 234 is where the bearing surface 230 deviates from the radii of the remainder of the bearing surface outside of the notch. Each notch 234 can be very small, e.g. a 0.0002 inches gap is provided between the bearing surface 230 at the notch 234 and the roller 22 (see FIG. 2).

FIG. 5 depicts only two notches 234 and is not drawn to scale. This is for clarity reasons. A plurality of notches 234 are formed along the bearing surface 230. In one embodiment, a respective notch 234 is formed every 1.15° with respect to the nominal center point 32 around the bearing surface 230 between a first end 260 of the bearing surface 230 and a second end of the bearing surface 232. The bearing surface 230 includes a support surface area that follows the first radius $r_1$ and the second radius $r_2$ and a notched surface area defined by the notches 234 formed in the bearing surface 230. The support surface area generally defines the area upon which the roller 22 (FIG. 2) bears. The notched surface area allows for oil to penetrate between the roller 22 (FIG. 2) and the bearing surface 230. In the embodiment described herein, a ratio of the support surface area to the notched surface area is about 90:10.

The notches 234 can be produced through form geometry. In other words, the roller pocket 218 can be formed prior to grinding with the grinding wheel assembly 52 (FIG. 3) to include the plurality of notches or grooves. FIG. 5 shows a "rough grind" surface 270 (depicted by a dashed line). The bearing surface 230 is first ground with the grinding wheel 52 (FIG. 3) in the manner described above to form the "rough grind" surface 270, i.e., the first section 236 is ground and then the second section 238 is ground. FIG. 5 also shows a "finish grind" surface, which is coincident with the bearing surface 230. The "finish grind" surface is formed using a second grinding wheel 310, which will be described in more detail with reference to FIG. 6. Again, FIG. 5 is not shown to scale. The "rough grind" surface 270 is much closer to the "finish grind" surface than what is shown in FIG. 5, e.g., on the order of a few to ten microns. Grinding using the second grinding wheel 310 controls the support surface area to the notched surface area ratio to about 90:10.

Figure 4A:
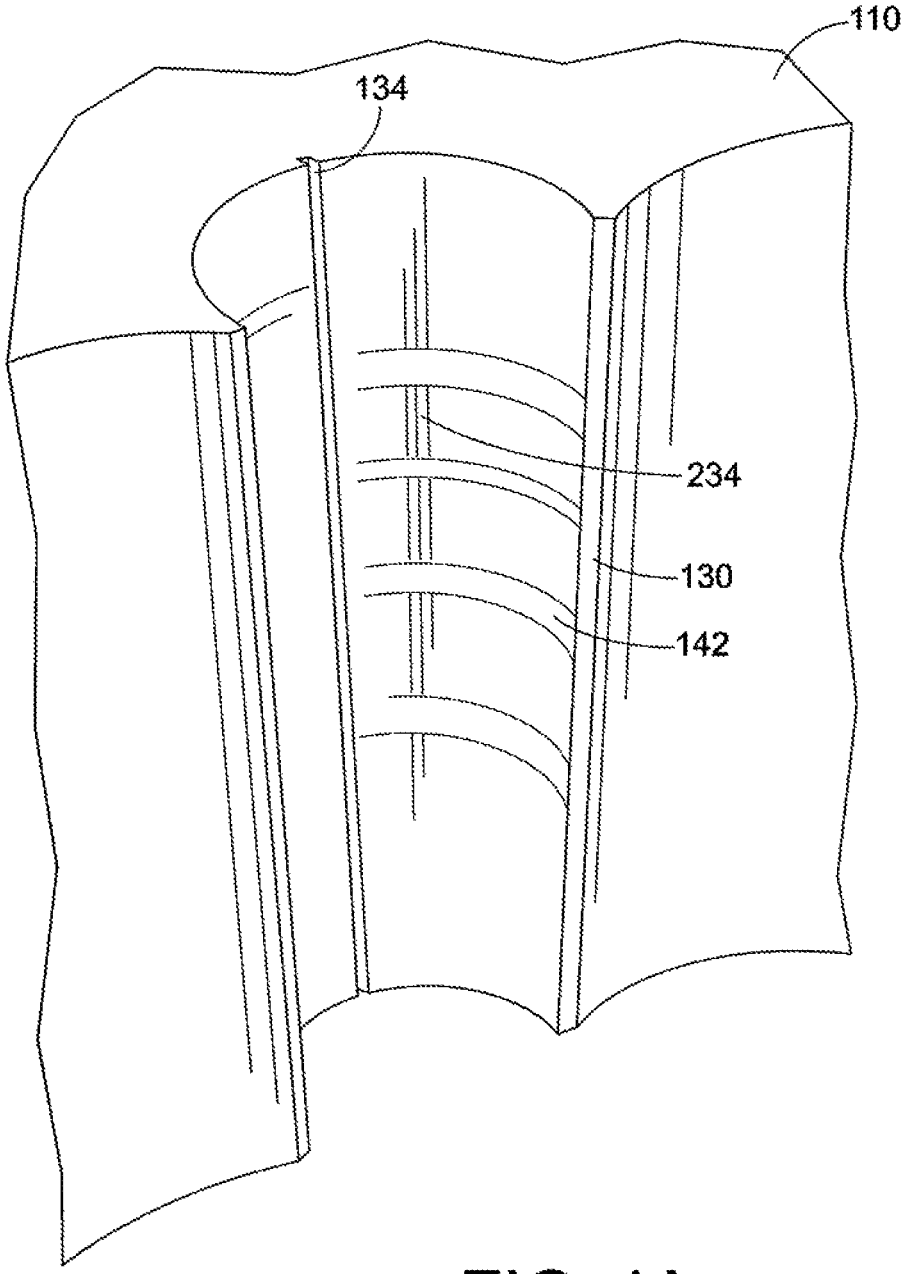
FIG. 4A is a perspective view of the portion of the stator and roller pocket depicted in FIG. 4.

The notches 234, which can also be referred to as grooves, are formed such that each bearing surface 230 includes a plurality of grooves. The notches (grooves) 234 extend in an axial direction, e.g., parallel to the central axis 16 (FIG. 1). The notches (grooves) 234 (see FIG. 4A) can also be formed with the grinding wheel 50. Since the grinding wheel 50 contacts the bearing surface in a direction that is substantially parallel with the central axis 16 (FIG. 1), these notches (grooves) 234 can be provided due to the grinding action of the grinding wheel 50. The notches (grooves) 234 extending in the axial direction can be referred to as axial grooves, and these axial grooves can be provided in addition to the circumferential grooves 142 (FIGS. 4 and 4A) described above to allow oil (hydraulic fluid) to penetrate between the roller 22 (FIG. 2) and the bearing surface 130 (FIG. 4) or the bearing surface 230 (FIG. 5).

Figure 6:
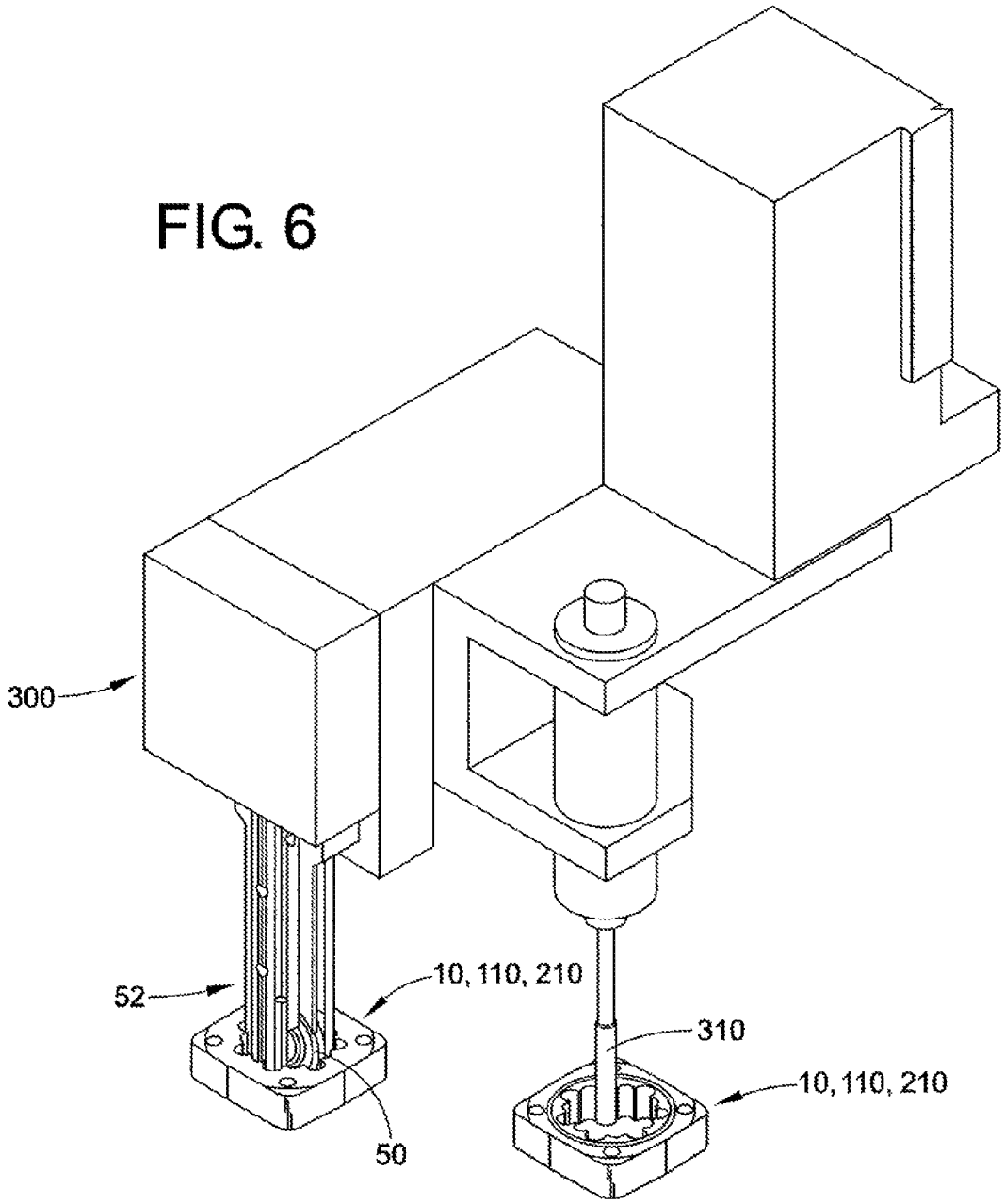
FIG. 6 depicts a grinding machine working on two stators.

FIG. 6 depicts the grinding wheel assembly 52 connected with a grinding machine 300. The grinding machine 300 can further include a second grinding wheel 310 that rotates about an axis parallel with the central axis 16 (FIG. 1) of the stator 10, 110, 210. The grinding wheel 50 (hereinafter first grinding wheel) of the grinding wheel assembly 52 grinds each bearing surface 30, 130, 230 prior to the second grinding wheel 310 grinding each bearing surface. The first grinding wheel 50 removes more stock (material) from the stator 10, 110 as compared to the second grinding wheel 210. For example, the first grinding wheel 50 can remove about ten times the amount of material as compared to the amount of material removed by the second grinding wheel 210. Utilizing the first grinding wheel 50 prior to the second grinding wheel 210 allows for the desirable shape of the bearing surface 30, 130, 230. Utilizing the second grinding wheel 210 after the first grinding wheel 50 provides radial groove lines on the bearing surface 30, 130, 230 as opposed to the longitudinal grooves left by the first grinding wheel 50.

By using the grinding wheel 50, described above, to form the bearing surfaces 30, 130, 230 of the roller pockets 18, 118, 218, the shape of the roller pocket can be modified, as compared to known shaping methods, to provide desirable results. For instance, the shape of the contact surface 58 in cross section taken normal to the central axis 16 of the stator 10, 110, 210 can be modified so as not to provide an exact radius. Instead each first section 36, 136, 236 of a respective roller pocket 18, 118, 218 can follow a curve defined by the cross section of the contact surface 58 of the grinding wheel. As such, each second section 38, 138, 238 would follow a similar curve.

Modification of the first section 36, 136, 236 and the second section 38, 138, 238 from an exact radius to a shape that follows the curve defined by the cross section of the contact surface 58 of the grinding wheel provides desirable sealing points in the rotor set. For example, FIG. 7 shows the rotor 24 positioned with respect to the rollers 22 of the stator 10 with three sealing points 80. In the position shown in FIG. 7, the rotor 24 fits tightest with respect to the rollers 22 at each of the three sealing points 80. Turning to FIG. 8, the rotor 24 has rotated and orbited from the position shown in FIG. 7. FIG. 8 shows the rotor 24 positioned with respect to the rollers 22 of the stator 10 at three other sealing points 82, two of which are in respective valleys 28 of the rotor. By modifying the shape of the first section 36, 136, 236 and the second section 38, 138, 238 from an exact radius to a shape that follows the curve defined by the cross section of the contact surface 58 of the grinding wheel 50, the same fit of the rotor 24 can be attained by the rotor in the position shown in FIG. 8 as compared to the position shown in FIG. 7.

A method for manufacturing roller pockets in a stator of a gerotor device and a stator for a gerotor device have been described above with particularity. Modifications and alterations will occur to those upon reading and understanding the preceding detailed description. The invention, however, is not limited to only the embodiments described above. Instead, the invention is broadly defined by the appended claims and the equivalents thereof.

The invention claimed is:

1. A method for manufacturing roller pockets in a stator of a gerotor device, the method comprising:

providing a stator having a cavity including a generally cylindrical section defining a central axis and a plurality of roller pockets angularly spaced around a periphery of the cylindrical section, wherein each roller pocket is configured to receive a respective roller, which acts as an internal tooth of the gerotor device, wherein each roller pocket defines a generally cylindrical roller pocket bearing surface having a plurality of grooves formed in the bearing surface;

grinding a first section of the roller pocket bearing surface of each roller pocket with a grinding wheel rotating about a rotational axis perpendicular to the central axis while a second section of the roller pocket bearing surface is not in contact with the grinding wheel, wherein the first section is located on a first side of a center line of the roller pocket and the second section is located on a second, opposite, side of the center line; and grinding the second section of the roller pocket bearing surface of each roller pocket with the grinding wheel rotating about a rotational axis perpendicular to the central axis while the first section of the roller pocket bearing surface is not in contact with the grinding wheel.

2. The method of claim 1, wherein a plane that is normal to the rotational axis of the grinding wheel is offset at an angle $\phi$ with respect to the center line while grinding the first section and the second section, wherein the angle $\phi$ is greater than 0°.

3. The method of claim 1, wherein grinding a first section of the bearing surface includes grinding a first section of the bearing surface of a first roller pocket located on a first side of a symmetrical axis of the stator;

wherein grinding a second section of the bearing surface includes grinding a second section of the bearing surface of a second roller pocket located on a, second, opposite side of the symmetrical axis of the stator; and the method further comprising moving at least one of the stator and the grinding wheel with respect to the other of the stator and the grinding wheel in a direction perpendicular to the symmetrical axis of the stator after grinding the first section of the bearing surface of the first roller pocket.

4. A method for manufacturing roller pockets in a stator of a gerotor device, the method comprising:

providing a stator having a cavity including a generally cylindrical section defining a central axis and a plurality of roller pockets angularly spaced around a periphery of the cylindrical section, wherein each roller pocket is configured to receive a respective roller, which acts as an internal tooth of the gerotor device, wherein each roller pocket defines a generally cylindrical roller pocket bearing surface;

grinding a first section of the roller pocket bearing surface of each roller pocket with a grinding wheel rotating about a rotational axis perpendicular to the central axis while a second section of the roller pocket bearing surface is not in contact with the grinding wheel, wherein the first section is located on a first side of a center line of the roller pocket and the second section is located on a second, opposite, side of the center line;

grinding the second section of the roller pocket bearing surface of each roller pocket with the grinding wheel rotating about a rotational axis perpendicular to the central axis while the first section of the roller pocket bearing surface is not in contact with the grinding wheel; and forming a circumferential groove in the bearing surface while grinding the first section.

5. The method of claim 4, further comprising forming another circumferential groove in the bearing surface while grinding the second section.

6. The method of claim 4, wherein a plane that is normal to the rotational axis of the grinding wheel is offset at an angle $\phi$ with respect to the center line while grinding the first section and the second section, wherein the angle $\phi$ is greater than 0°.

7. The method of claim 4, wherein grinding a first section of the bearing surface includes grinding a first section of the bearing surface of a first roller pocket located on a first side of a symmetrical axis of the stator;

wherein grinding a second section of the bearing surface includes grinding a second section of the bearing surface of a second roller pocket located on a, second, opposite side of the symmetrical axis of the stator; and the method further comprising moving at least one of the stator and the grinding wheel with respect to the other of the stator and the grinding wheel in a direction perpendicular to the symmetrical axis of the stator after grinding the first section of the bearing surface of the first roller pocket.

8. A method for manufacturing roller pockets in a stator of a gerotor device, the method comprising:

providing a stator having a cavity including a generally cylindrical section defining a central axis and a plurality of roller pockets angularly spaced around a periphery of the cylindrical section, wherein each roller pocket is configured to receive a respective roller, which acts as an internal tooth of the gerotor device, wherein each roller pocket defines a generally cylindrical roller pocket bearing surface;

grinding a first section of the roller pocket bearing surface of each roller pocket with a grinding wheel rotating about a rotational axis perpendicular to the central axis while a second section of the roller pocket bearing surface is not in contact with the grinding wheel, wherein the first section is located on a first side of a center line of the roller pocket and the second section is located on a second, opposite, side of the center line; and grinding the second section of the roller pocket bearing surface of each roller pocket with the grinding wheel rotating about a rotational axis perpendicular to the central axis while the first section of the roller pocket bearing surface is not in contact with the grinding wheel, wherein grinding a first section of the roller pocket bearing surface of each roller pocket with a grinding wheel includes grinding the first section of the roller pocket bearing surface of each roller pocket with a contact surface of the grinding wheel, which in a cross section taken normal to a central axis of the stator, follows a radius r1 about a first point, and wherein grinding a second section of the roller pocket bearing surface of each roller pocket with a grinding wheel includes grinding the second section of the roller pocket bearing surface of each roller pocket with the contact surface of the grinding wheel, which in a cross section taken normal to a central axis of the stator, follows a radius r2 about a second point, which is offset from the first point, wherein r1 is equal in magnitude to r2.

9. The method of claim 8, wherein the first point is located on the same side of a center line of the roller pocket and closer to the first section of the bearing surface as compared to a rotational axis of the roller when in an unpressurized state.

10. The method of claim 9, wherein the second point is located on the same side of a center line of the roller pocket and closer to the second section of the bearing surface as compared to a rotational axis of the roller when in an unpressurized state.

11. A stator for gerotor device comprising:

a plurality of rollers;

a stator body having a forward face, a rear face, a cavity including a generally cylindrical section defining a central axis and a plurality of roller pockets angularly spaced around a periphery of the cylindrical section, wherein each roller pocket defines a nominal center point, wherein each roller pocket receives a respective roller, which acts as an internal tooth of the stator, wherein each roller pocket includes a generally cylindrical roller pocket bearing surface, against which the respective roller received in the roller pocket bears, wherein each bearing surface extends along an arc that partially surrounds the respective roller received in the roller pocket, wherein the arc is greater than 185 degrees, wherein each bearing surface includes a first section following a first curve and a second section following a second curve, wherein each curve is substantially circular, wherein the first curve is a substantial mirror image of the second curve with respect to a center line through the respective roller pocket and the respective bearing surface deviates from each curve at or adjacent an area of the respective bearing surface intersected by the center line, wherein the first curve follows a first radius and the second curve follows a second radius, wherein the first radius and the second radius each emanate from a respective point located offset from the nominal center point, wherein the first radius and the second radius provide an interference layout when the gerotor device is in an unpressurized state.

12. The stator of claim 11, wherein the first radius and the second radius are equal in magnitude.

13. The stator of claim 11, wherein the second radius emanates from a second point located on the same side of the center line of the roller pocket and closer to the second section of the bearing surface as compared to the rotational axis of the roller when the gerotor device is in an unpressurized state.

14. The stator of claim 11, wherein the arc is between about 185 degrees and about 220 degrees with respect to a nominal center point of the roller pocket.

15. The stator of claim 11, wherein each bearing surface includes a notch or a flat section interposed between the first section and the second section.

16. The stator of claim 11, wherein each bearing surface includes a plurality of grooves formed in the bearing surface.

17. The stator of claim 16, wherein each groove is a circumferential groove that extends into the bearing surface and generally follows the arc of the bearing surface.

18. The stator of claim 17, wherein each circumferential groove ends spaced from a respective end of the bearing surface.

* * * * *